US011183116B2

(12) United States Patent
Yang et al.

(10) Patent No.: US 11,183,116 B2
(45) Date of Patent: Nov. 23, 2021

(54) DISPLAY DEVICE AND METHOD OF COMPENSATING FOR DEGRADATION THEREOF

(71) Applicant: Samsung Display Co., Ltd., Yongin-si (KR)

(72) Inventors: Su Min Yang, Yongin-si (KR); Bo Young An, Yongin-si (KR); Wook Lee, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 58 days.

(21) Appl. No.: 16/566,348

(22) Filed: Sep. 10, 2019

(65) Prior Publication Data

US 2020/0143739 A1 May 7, 2020

(30) Foreign Application Priority Data

Nov. 6, 2018 (KR) ..... 10-2018-0135408

(51) Int. Cl.
*G09G 3/3233* (2016.01)

(52) U.S. Cl.
CPC ..... *G09G 3/3233* (2013.01); *G09G 2310/027* (2013.01); *G09G 2310/08* (2013.01); *G09G 2320/0233* (2013.01); *G09G 2320/0285* (2013.01); *G09G 2360/16* (2013.01)

(58) Field of Classification Search
CPC ..... G09G 3/32–3291
See application file for complete search history.

(56) References Cited

U.S. PATENT DOCUMENTS

| | | | | |
|---|---|---|---|---|
| 8,330,678 | B2 | 12/2012 | Kohno et al. | |
| 8,497,827 | B2 | 7/2013 | Lee | |
| 2009/0058772 | A1* | 3/2009 | Lee | G09G 3/3233 345/82 |
| 2017/0039953 | A1* | 2/2017 | Lee | G09G 3/3233 |

FOREIGN PATENT DOCUMENTS

| | | | |
|---|---|---|---|
| JP | 5010814 | B2 | 8/2012 |
| KR | 10-1453970 | B1 | 10/2014 |
| KR | 10-2016-0025818 | A | 3/2016 |
| KR | 10-2017-0021678 | A | 2/2017 |

* cited by examiner

*Primary Examiner* — Hang Lin
(74) *Attorney, Agent, or Firm* — Lewis Roca Rothgerber Christie LLP

(57) ABSTRACT

There are provided a display device and a method of compensating for degradation thereof. The display device includes a display panel including pixels, a sensing unit configured to measure threshold voltages of the pixels, respectively, and a timing controller configured to determine grayscale compensation values with respect to the pixels corresponding to the threshold voltages, respectively, and to compensate input image data with respect to the pixels based on the grayscale compensation values, respectively, wherein the grayscale compensation values have a linear relationship with a grayscale of the input image data by using a linear slope value determined based on the threshold voltages.

18 Claims, 5 Drawing Sheets

DISPLAY DEVICE AND METHOD OF COMPENSATING FOR DEGRADATION THEREOF

CROSS-REFERENCE TO RELATED APPLICATION

This application claims priority to, and the benefit of, Korean patent application 10-2018-0135408 filed on Nov. 6, 2018 in the Korean Intellectual Property Office, the entire disclosure of which is incorporated herein by reference.

BACKGROUND

1. Field

Embodiments of the present disclosure generally relate to a display device and a method of compensating for degradation thereof.

2. Related Art

In general, in an organic light emitting display device including an organic light emitting diode, degradation of the organic light emitting diode or of a driving transistor (hereinafter, referred to as "degradation of a pixel") occurs corresponding to a driving time and a driving current amount when time elapses. When pixels are degraded, luminance of the pixels is lowered. Therefore, display quality may be deteriorated, or an afterimage may occur on a screen.

Threshold voltages (Vth) of driving transistors provided in pixels are different depending on positions at which the pixels are located. A variation in threshold voltage results from a process error in a process of forming a thin film transistor. Although the same driving voltage is applied to the driving transistors of the respective pixels, a difference between currents flowing through the organic light emitting diodes is caused. As a result, the pixels emit lights with different luminances.

In particular, when a pixel displays a white image for a long time, the threshold voltage of the driving transistor is moved in a negative direction due to Negative Bias Temperature illumination Stress (NTBis) or the like, which is applied to the driving transistor. A data voltage may be compensated from the outside corresponding to the movement of the threshold voltage. However, the range of compensation is restricted, and therefore, there is a limitation in compensating for the threshold voltage. In particular, when the threshold voltage is out of the range of compensation because the threshold voltage is continuously moved in the negative direction, luminance increases, and therefore, the reliability of the display device is lowered.

SUMMARY

Embodiments disclosed herein provide a display device capable of accurately compensating for degradation of a pixel by considering a position at which the pixel is located, and a method of compensating for degradation of the display device.

Embodiments also provide a display device capable of stably compensating for degradation of a pixel even when a threshold voltage is moved in a negative direction, and a method of compensating for degradation of the display device.

According to an aspect of the present disclosure, there is provided a display device including a display panel including pixels, a sensing unit configured to measure threshold voltages of the pixels, respectively, and a timing controller configured to determine grayscale compensation values with respect to the pixels corresponding to the threshold voltages, respectively, and to compensate input image data with respect to the pixels based on the grayscale compensation values, respectively, wherein the grayscale compensation values have a linear relationship with a grayscale of the input image data by using a linear slope value determined based on the threshold voltages.

The timing controller may be configured to respectively calculate threshold voltage mobilities of the pixels based on a minimum threshold voltage among the threshold voltages, to respectively calculate grayscale compensation levels of the pixels from the threshold voltage mobilities, and to generate the linear slope value and the grayscale compensation values based on the grayscale compensation levels.

The threshold voltage mobilities may be calculated using the following Equation 1.

$$\Delta Vth = Vth - Vth(\text{target}) \qquad \text{Equation 1}$$

Here, ΔVth is the threshold voltage mobility, Vth is a measured threshold voltage, and Vth(target) is the minimum threshold voltage.

The grayscale compensation levels may be calculated using the following Equation 2.

$$\Delta\text{Gray} = \Delta Vth \times \frac{2^{bit}}{Vdata(\text{max gray}) - Vdata(\text{min gray})} \qquad \text{Equation 2}$$

Here, ΔGray is the grayscale compensation level, ΔVth is the threshold voltage mobility, bit is a bit number of the input image data, Vdata(max gray) is a data voltage corresponding to a maximum grayscale of the input image data, and Vdata(min gray) is a data voltage corresponding to a minimum grayscale of the input image data.

The linear slope value may be set with respect to each of the pixels, and may be calculated using the following Equation 3.

$$\alpha = \frac{2^{bit} - 1 - \Delta\text{GRAY}}{2^{bit} - 1} \qquad \text{Equation 3}$$

Here, α is the linear slope value, and ΔGray is a grayscale compensation level of each of the pixels.

The linear slope value may be equally set with respect to the pixels, and be calculated using the following Equation 4.

$$\alpha = \frac{2^{bit} - 1 - \Delta\text{GRAY}}{2^{bit} - 1} \qquad \text{Equation 4}$$

Here, α is the linear slope value, and ΔGray is a grayscale compensation level of a pixel having a maximum threshold voltage among the threshold voltages.

The grayscale compensation values may be calculated using the following Equation 5.

$$\text{GRAY}' = \alpha \times \text{GRAY} + \Delta\text{GRAY} \qquad \text{Equation 5}$$

Here, GRAY' is the grayscale compensation value, GRAY is the grayscale of the input image data, ΔGray is the grayscale compensation level, a is the linear slope value.

The timing controller may be configured to store the linear slope value and the grayscale compensation level with respect to each of the pixels in a lookup table.

When externally supplied arbitrary input image data is received, the timing controller may be configured to load the linear slope value and the grayscale compensation level, which correspond to a pixel in which the arbitrary input image data is to be displayed, from the lookup table, and may be configured to determine the grayscale compensation value with respect to a grayscale of the input image data based on the linear slope value and the grayscale compensation level.

According to another aspect of the present disclosure, there is provided a method of compensating for degradation of a display device, the method including respectively measuring threshold voltages of pixels, respectively storing grayscale compensation values with respect to the pixels corresponding to the threshold voltages, and compensating for input image data corresponding to the pixels based on the grayscale compensation values, which are defined to have a linear relationship with a grayscale of the input image data according to a linear slope value determined based on the threshold voltages.

The determining of the grayscale compensation values may include respectively calculating threshold voltage mobilities of the pixels based on a minimum threshold voltage among the threshold voltages, respectively calculating grayscale compensation levels of the pixels from the threshold voltage mobilities, and generating the linear slope value and the grayscale compensation values based on the grayscale compensation levels.

The threshold voltage mobilities may be calculated using the following Equation 6.

$$\Delta Vth = Vth - Vth(\text{target}) \quad \text{Equation 6}$$

Here, ΔVth is the threshold voltage mobility, Vth is a measured threshold voltage, and Vth(target) is the minimum threshold voltage.

The grayscale compensation levels may be calculated using the following Equation 7.

$$\Delta\text{Gray} = \Delta Vth \times \frac{2^{bit}}{Vdata(\text{max gray}) - Vdata(\text{min gray})} \quad \text{Equation 7}$$

Here, ΔGray is the grayscale compensation level, ΔVth is the threshold voltage mobility, bit is a bit number of the input image data, Vdata(max gray) is a data voltage corresponding to a maximum grayscale of the input image data, and Vdata(min gray) is a data voltage corresponding to a minimum grayscale of the input image data.

The linear slope value may be set with respect to each of the pixels, and be calculated using the following Equation 8.

$$\alpha = \frac{2^{bit} - 1 - \Delta\text{GRAY}}{2^{bit} - 1} \quad \text{Equation 8}$$

Here, α is the linear slope value, and ΔGray is a grayscale compensation level of each of the pixels.

The linear slope value may be equally set with respect to the pixels, and be calculated using the following Equation 9.

$$\alpha = \frac{2^{bit} - 1 - \Delta\text{GRAY}}{2^{bit} - 1} \quad \text{Equation 9}$$

Here, α is the linear slope value, and ΔGray is a grayscale compensation level of a pixel having a maximum threshold voltage among the threshold voltages.

The grayscale compensation values may be calculated using the following Equation 10.

$$\text{GRAY}' \times \text{GRAY} + \Delta\text{GRAY} \quad \text{Equation 10}$$

Here, GRAY' is the grayscale compensation value, GRAY is the grayscale of the input image data, ΔGray is the grayscale compensation level, α is the linear slope value.

In the storing the grayscale compensation values, the linear slope value and the grayscale compensation level with respect to each of the pixels may be stored in a lookup table.

The compensating for of the input image data may include, when arbitrary input image data is received from the outside, loading the linear slope value and the grayscale compensation level, which correspond to a pixel in which the arbitrary input image data is to be displayed, from the lookup table, determining the grayscale compensation value with respect to a grayscale of the input image data based on the loaded linear slope value and the loaded grayscale compensation level, and outputting compensated image data, corresponding to the determined grayscale compensation value.

DETAILED DESCRIPTION

Figure 1:
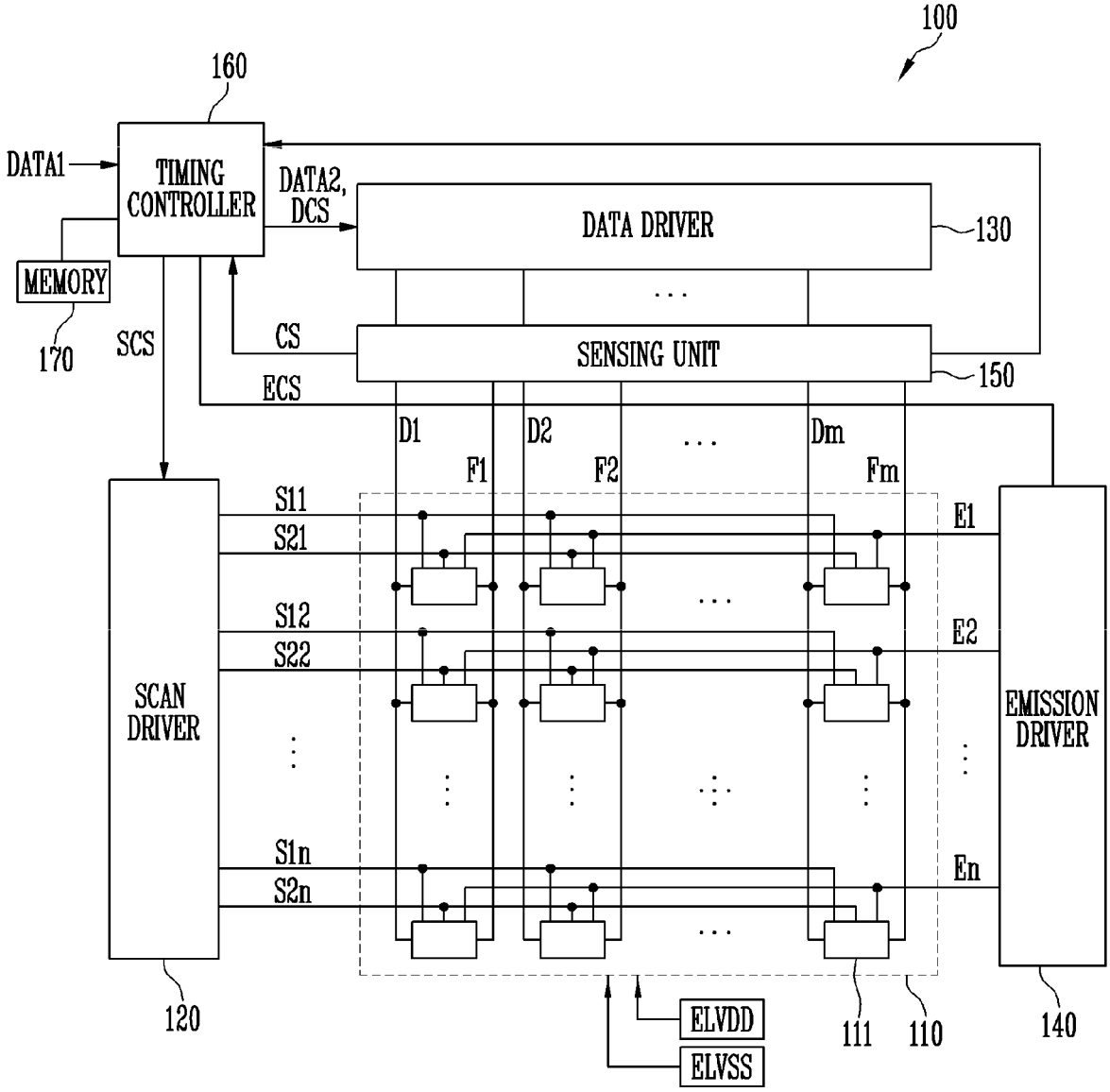
FIG. 1 is a diagram illustrating a display device according to an embodiment of the present disclosure.

Features of the inventive concept and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described. Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Additionally, as those skilled in the art would realize, the described embodiments may be modified in various different ways, all without departing from the spirit or scope of the present disclosure.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a diagram illustrating a display device according to an embodiment of the present disclosure.

Referring to FIG. 1, the display device 100 according to the embodiment of the present disclosure may include a display panel 110, a scan driver 120, a data driver 130, an emission driver 140, a sensing unit 150, a timing controller 160, and a memory 170. The display device 100 may be a device that outputs an image based on externally supplied image data (e.g., first data DATA1) that is provided from the outside. For example, the display device 100 may be an organic light emitting display device.

The display panel 110 may include a plurality of first scan lines S11 to S1*n*, a plurality of second scan lines S21 to S2*n*, a plurality of data lines D1 to Dm, a plurality of emission control lines E1 to En, a plurality of feedback lines F1 to Fm, and a plurality of pixels 111 (n and m are integers of 2 or more). The pixels 111 may be arranged at intersection portions of the first scan lines S11 to S1*n*, the second scan lines S21 to S2*n*, the data lines D1 to Dm, the emission control lines E1 to En, and the feedback lines F1 to Fm.

Each of the pixels 111 may store a data signal in response to a first scan signal and a second scan signal, and may emit light based on the stored data signal. A configuration of the pixel 111 will be described in detail with reference to FIG. 2.

The scan driver 120 may generate the first scan signal and the second scan signal based on a scan driving control signal SCS. That is, the scan driver 120 may supply the first scan signal to the pixels 111 through the first scan lines S11 to S1*n* during a display period in one frame, and may supply the second scan signal to the pixels 111 through the second scan lines S21 to S2*n* during a sensing period for sensing characteristics of the pixels 111. The scan driving control signal SCS may be provided to the scan driver 120 from the timing controller 160. The scan driving control signal SCS may include a start pulse and clock signals, and the scan driver 120 may include a shift register that sequentially generates a scan signal corresponding to the start pulse and the clock signals.

The data driver 130 may generate a data signal based on a data driving control signal DCS and image data (e.g., second data DATA2). The data driver 130 may provide the display panel 110 with the data signal generated based on the data driving control signal DCS during the display period. That is, the data driver 130 may supply the data signal to the pixels 111 through the data lines D1 to Dm. The data driving control signal DCS may be provided to the data driver 130 from the timing controller 160.

The sensing unit 150 may be coupled to the feedback lines F1 to Fm, and may measure (or sense) a characteristic of a pixel 111 based on a control signal CS. The characteristic of the pixel 111 is a characteristic of a driving transistor provided in each pixel 111, and may include a threshold voltage Vth of the driving transistor, mobility information, and/or the like. The sensing unit 150 may transfer information on the measured characteristic of the pixel 111 to the timing controller 160.

In some embodiments, the data driver 130 may apply a sensing voltage to a specific data line (e.g., an mth data line Dm) in response to the control signal CS during the sensing period, and the sensing unit 150 may measure a characteristic of the driving transistor provided one or more pixels 111 from a current or voltage fed back through a corresponding feedback line (e.g., an mth feedback line Fm) in response to the sensing voltage.

The emission driver 140 may generate an emission control signal based on an emission driving control signal ECS. The emission driving control signal ECS may be provided to the emission driver 140 from the timing controller 160. The emission driver 140 may simultaneously or sequentially generate the emission control signal based on the emission driving control signal ECS and clock signals.

The timing controller 160 may control operations of the scan driver 120, the data driver 130, the emission driver 140, and the sensing unit 150. The timing controller 160 may generate the scan driving control signal SCS, the data driving control signal DCS, the emission driving control signal ECS, and the control signal CS, and may control each of the scan driver 120, the data driver 130, the emission driver 140, and the sensing unit 150 based on the generated signals.

In various embodiments of the present disclosure, the timing controller 160 may calculate a threshold voltage mobility of each pixel 111 based on a characteristic of the pixel 111, and may correct input image data (e.g., first image data DATA1) based on the threshold voltage mobility.

For example, the timing controller 160 may calculate a threshold voltage mobility by comparing threshold voltages Vth of the pixels 111, which are measured during the sensing period, with a target threshold voltage. The target threshold voltage may be a minimum threshold voltage Vth(min) among the threshold voltages Vth measured with respect to the pixels 111.

The timing controller 160 may determine a grayscale compensation level from the calculated threshold voltage mobility, and may calculate a grayscale compensation value corresponding to the grayscale compensation level. In an embodiment, the grayscale compensation value may be calculated using a linear equation. The linear equation may include a correlation between a grayscale of the input image data and the grayscale compensation value. The timing controller 160 may store information related to the grayscale compensation value defined by a linear equation in the form of a lookup table, etc.

The timing controller 160 may acquire a grayscale compensation value corresponding to the grayscale of the input image data (e.g., the first image data DATA1) by using the lookup table stored as described above, and may generate corrected image data (e.g., second image data DATA2) by reflecting the acquired grayscale compensation value, and then may provide the corrected image data to the data driver 130.

The memory 170 may store the lookup table having grayscale compensation values generated by the timing controller 160 as described above.

In various embodiments, the display device 100 may further include a power supply unit. The power supply unit may generate a driving voltage that is suitable for driving of the display device 100. The driving voltage may include a first driving voltage ELVDD and a second driving voltage ELVSS. The first driving voltage ELVDD may be larger than the second driving voltage ELVSS.

Meanwhile, although FIG. 1 illustrates that the display panel 110 includes the feedback lines F1 to Fm, and that the data driver 130 is coupled to the feedback lines F1 to Fm, the display panel 110 is not limited thereto. For example, the display panel 110 of other embodiments does not include the feedback lines F1 to Fm, and may use the data lines D1 to Dm as the feedback lines F1 to Fm through time-division driving.

Figure 2:
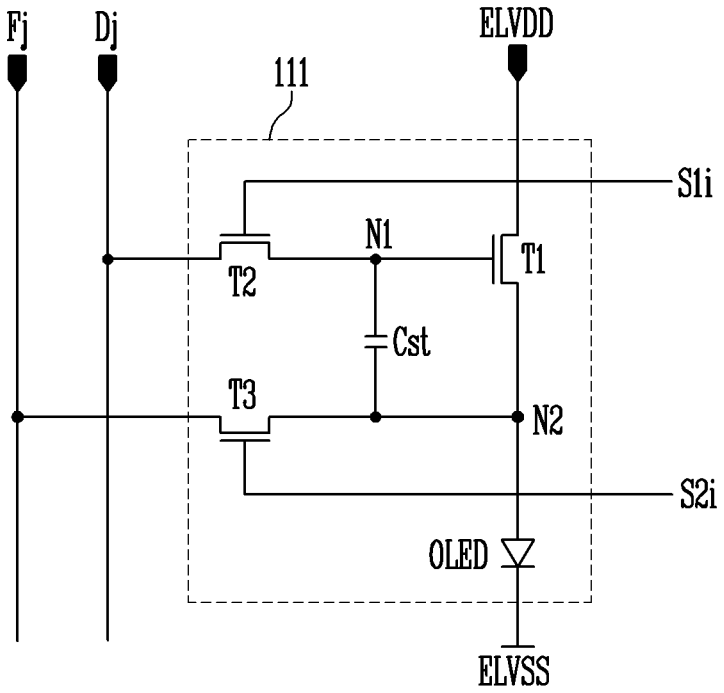
FIG. 2 is a diagram illustrating an example of a pixel shown in FIG. 1.

FIG. 2 is a diagram illustrating an example of the pixel shown in FIG. 1.

Referring to FIG. 2, the pixel 111 may include first to third transistors T1 to T3, a storage capacitor Cst, and an organic light emitting diode OLED. The pixel 111 may be coupled to the data driver 130 through a data line Dj, and may be coupled to the sensing unit 150 through a feedback line Fj. Also, the pixel 111 may be coupled to the scan driver 120 through a first scan line S1*i* and a second scan line S2*i*.

An anode electrode of the organic light emitting diode OLED may be coupled to a second electrode of the first transistor T1 (e.g., to a second node N2), and a cathode electrode of the organic light emitting diode OLED may be coupled to a second driving power source ELVSS. The organic light emitting diode OLED generates light (e.g., with a predetermined luminance) corresponding to an amount of current supplied from the first transistor T1.

A first electrode of the first transistor (driving transistor) T1 may be coupled to a first driving power source ELVDD, and the second electrode of the first transistor T1 may be coupled to the anode electrode of the organic light emitting diode OLED/the second node N2. A gate electrode of the first transistor T1 may be coupled to a first node N1. The first transistor T1 controls an amount of current flowing through the organic light emitting diode OLED corresponding to a voltage of the first node N1.

A first electrode of the second transistor T2 may be coupled to the data line Dj, and a second electrode of the second transistor T2 may be coupled to the first node N1. A gate electrode of the second transistor T2 may be coupled to the first scan line S1*i*. The second transistor T2 may be turned on when a first scan signal is supplied to the first scan line S1*i* to transfer a voltage from the data line Dj to the first node N1.

In various embodiments of the present disclosure, a data signal may be supplied to the data line Dj in synchronization with a first scan signal supplied during a display period, and a sensing voltage may be supplied to the data line Dj in synchronization with a first scan signal supplied during a sensing period.

The third transistor T3 may be coupled between the feedback line Fj and the second electrode of the first transistor T1/the second node N2. A gate electrode of the third transistor T3 may be coupled to the second scan line S2*i*. The third transistor T3 may be turned on when a second scan signal is supplied to the second scan line S2*i* to electrically couple the feedback line Fj and the second node N2 to each other.

In various embodiments of the present disclosure, a reference voltage may be supplied to the feedback line Fj in synchronization with a second scan signal supplied during the display period, and an arbitrary current or voltage may be supplied to the feedback line Fj from the second node N2 in synchronization with a second scan signal supplied during the sensing period. The current or voltage supplied to the feedback line Fj during the sensing period may be transferred to the sensing unit 150, and may be used to measure a characteristic of the pixel 111. The characteristic of the pixel 111 may include a threshold voltage Vth of the first transistor T1 and/or mobility information.

The storage capacitor Cst may be coupled between the first node N1 and the second node N2. The storage capacitor Cst may store a voltage corresponding to a difference in voltage between the first node N1 and the second node N2.

In various embodiments of the present disclosure, luminance of the pixel 111 is mainly determined by the data signal. However, a characteristic value of the first transistor T1 may be additionally reflected to the luminance of the pixel 111. That is, in the present disclosure, an external compensation method may be applied in which a characteristic of the first transistor T1 is sensed during the sensing period, and first data DATA1 is changed by reflecting information on the sensed characteristic. In this embodiment, an image having uniform image quality can be displayed in the display panel 110, regardless of a variation in a characteristic of the first transistor T1.

In various embodiments of the present disclosure, the sensing period in which characteristics of the pixels 111 are measured may be performed at least once before the display device 100 is released in the market (e.g., during a manufacturing phase). Initial characteristic information of the first transistor T1 may be stored before the display device 100 is released in the market, and the first data DATA1 is corrected (e.g., second data DATA2 is generated) using the characteristic information so that an image having uniform image quality may be displayed in the display panel 110.

Alternatively, in various embodiments of the present disclosure, the sensing period in which characteristics of the pixels 111 are measured may be performed even after the display device 100 is actually used. For example, the sensing period may be located at a portion of a time at which the display device is on and/or a time at which the display device is off. Also, the sensing period may be located at a portion of a vertical blank period occurring between respective display periods. Then, characteristic information may be updated in real time (e.g., the characteristic of the driving transistor/the first transistor T1 included in each of the pixels 111), to be reflected to data signal generation, even while the display device 100 is being driven. Thus, the display panel 110 can continuously display an image having uniform image quality.

Figure 3:
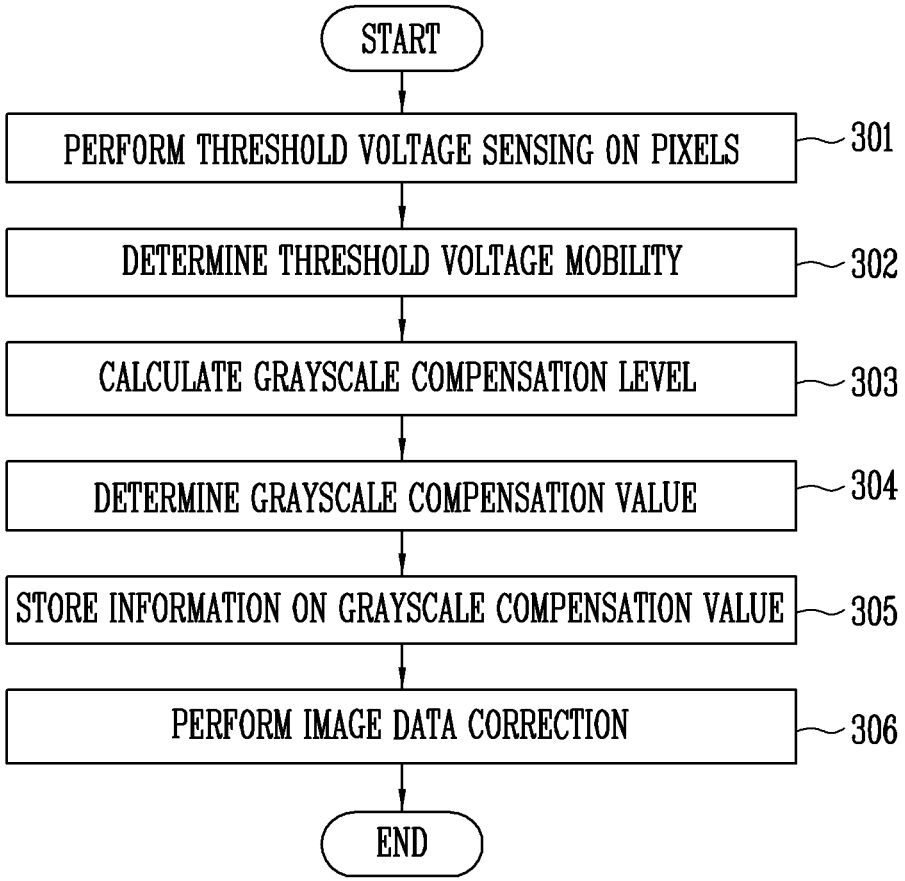
FIG. 3 is a flowchart illustrating a method of compensating for degradation of the display device according to an embodiment of the present disclosure.
Figure 4:
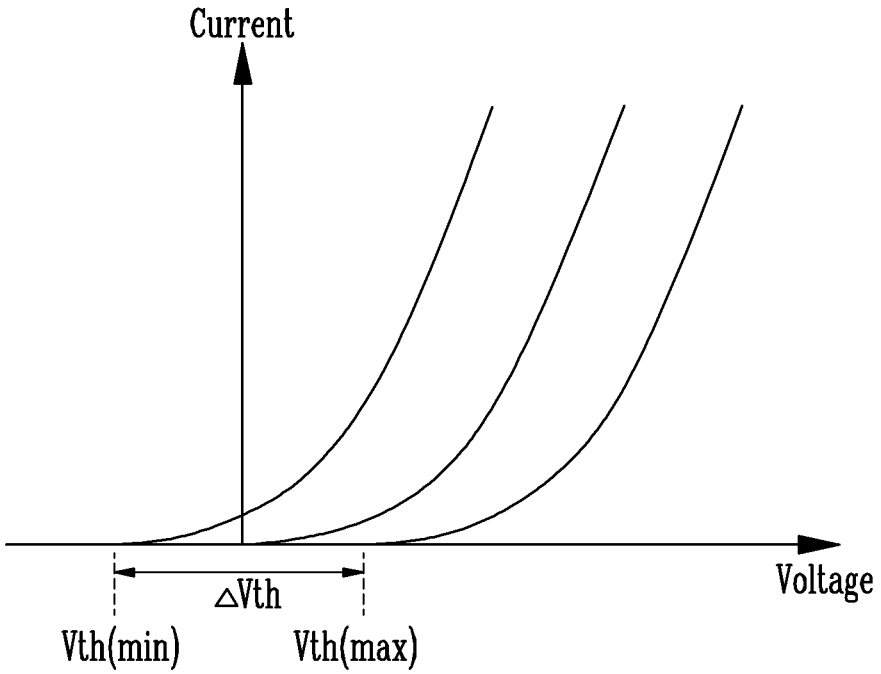
FIG. 4 is a diagram illustrating movement of threshold voltages of pixels.
Figure 5:
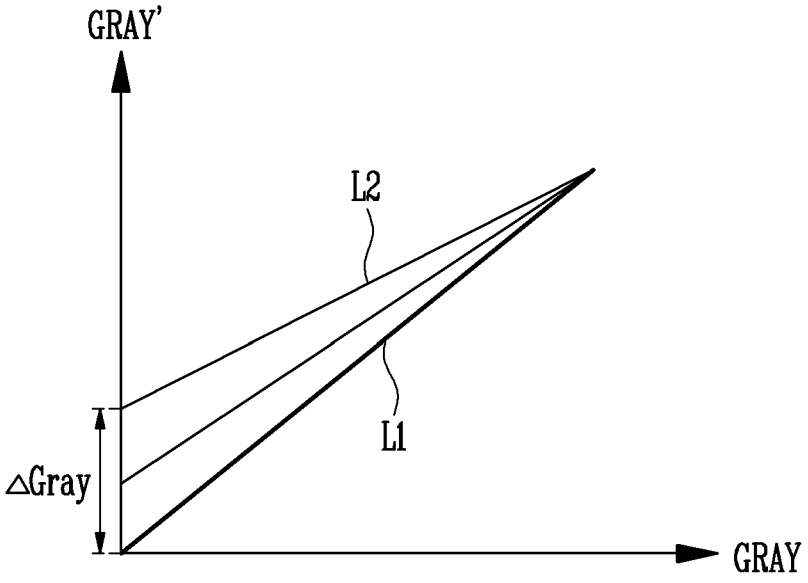
FIG. 5 is a diagram illustrating a method of compensating for degradation of the display device according to a first embodiment of the present disclosure.
Figure 6:
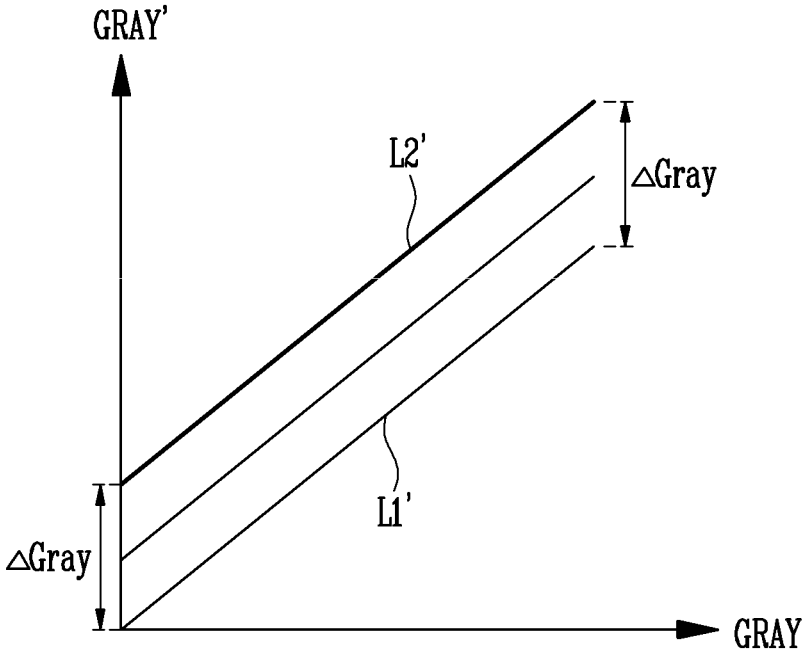
FIG. 6 is a diagram illustrating a method of compensating for degradation of the display device according to a second embodiment of the present disclosure.

FIG. 3 is a flowchart illustrating a method of compensating for degradation of the display device according to an embodiment of the present disclosure. FIG. 4 is a diagram illustrating movement of threshold voltages of the pixels. FIG. 5 is a diagram illustrating a method of compensating for degradation of the display device according to a first embodiment of the present disclosure. FIG. 6 is a diagram illustrating a method of compensating for degradation of the display device according to a second embodiment of the present disclosure.

Referring to FIG. 3, the display device 100 according to the embodiment of the present disclosure performs threshold voltage sensing on the pixels 111 (301).

The data driver 130 may measure threshold voltages Vth of the driving transistors provided in the pixels 111 when a driving time elapses, and may transfer the measured threshold voltages Vth to the timing controller 160. The measurement of the threshold voltages Vth may be performed on each of pixels 111 selected in the above-described sensing period. The threshold voltage Vth measured with respect to each of the pixel 111 may have a value moved within the range of a minimum threshold voltage Vth(min) to a maximum threshold voltage Vth(max), as compared with an initial threshold voltage as shown in FIG. 4.

Next, the display device 100 determines a threshold voltage mobility with respect to each of the pixels 111 by comparing the threshold voltages Vth measured with respect to the pixels 111 with a target threshold voltage (302). In various embodiments of the present disclosure, the target threshold voltage may be the minimum threshold voltage Vth(min) among the threshold voltages Vth measured with respect to the pixels 111.

In an embodiment of the present disclosure, the timing controller 160 may calculate a threshold voltage mobility, using the following Equation 1, based on the threshold voltage measured with each of the pixels 111.

$$\Delta Vth = Vth - Vth(\text{target}) \qquad \text{Equation 1}$$

Here, ΔVth is the threshold voltage mobility, Vth is the measured threshold voltage, and Vth(target) is the target threshold voltage.

Next, the display device 100 calculates a grayscale compensation level of each of the pixels 111 from the threshold voltage mobility (303). For example, the timing controller 160 may allocate data voltages respectively corresponding to grayscales constituting image data. Also, the timing controller 160 may calculate a grayscale compensation level from the threshold voltage mobility by using allocated data voltages respectively corresponding to maximum and minimum grayscales of the image data and a bit number of the image data. In an embodiment, the grayscale compensation level may be calculated using the following Equation 2.

$$\Delta\text{Gray} = \Delta Vth \times \frac{2^{bit}}{Vdata(\text{max gray}) - Vdata(\text{min gray})} \qquad \text{Equation 2}$$

Here, ΔGray is the grayscale compensation level, ΔVth is the threshold voltage mobility, bit (of $2^{bit}$) is the bit number of the image data, Vdata(max gray) is a data voltage corresponding to the maximum grayscale, and Vdata(min gray) is a data voltage corresponding to the minimum grayscale. In an example of the present embodiment, the maximum grayscale is a grayscale corresponding to white, which is grayscale 255, and the minimum grayscale is a grayscale corresponding to black, which is grayscale 0.

Next, the display device 100 determines a grayscale compensation value of each of the pixels 111 from the grayscale compensation level (304). In an embodiment, the grayscale compensation value means a compensated grayscale with respect to a grayscale of input image data, and may be defined as a linear equation including a correlation between the grayscale of the image data and the compensated grayscale. In an embodiment, the linear equation may be defined using the following Equation 3.

$$GRAY' = \alpha \times GRAY + \Delta GRAY \quad \text{Equation 3}$$

Here, GRAY' is the grayscale compensation value, GRAY is the grayscale of the input image data, and ΔGray is the grayscale compensation level. In addition, α is a value defined using the following Equation 4.

$$\alpha = \frac{2^{bit} - 1 - \Delta GRAY}{2^{bit} - 1} \quad \text{Equation 4}$$

In the first embodiment of the present disclosure, a may be set with respect to each of the pixels 111. That is, in the first embodiment of the present disclosure, a may have a different value, which may correspond to the grayscale compensation level of each of the pixels 111. A linear relationship between grayscales of input image data and the grayscale compensation value, which is defined in the present embodiment, is illustrated in FIG. 5. A first straight line L1 of FIG. 5 represents a linear relationship of a pixel of which threshold voltage mobility is 0 (e.g., a pixel having the minimum threshold voltage Vth(min)), and a second straight line L2 of FIG. 5 represents a linear relationship of a pixel of which threshold voltage mobility is maximum (e.g., a pixel having the maximum threshold voltage Vth (max)). As shown in FIG. 5, straight lines representing relationships between grayscales of image data and the grayscale compensation value, which correspond to the threshold voltage mobilities, may have different slopes (α).

Meanwhile, in the second embodiment of the present disclosure, a may be set based on a pixel having the maximum threshold voltage Vth(max). That is, in the second embodiment of the present disclosure, a may be determined corresponding to a grayscale compensation level of the pixel having the maximum threshold voltage Vth(max), and may be determined as the same value with respect to all the pixels 111. A linear relationship between grayscales of input image data and the grayscale compensation value, which is defined in the present embodiment, is illustrated in FIG. 6. A first straight line L1' of FIG. 6 represents a linear relationship of a pixel of which threshold voltage mobility is 0 (e.g., a pixel having the minimum threshold voltage Vth(min)), and a second straight line L2' of FIG. 6 represents a linear relationship of a pixel of which threshold voltage mobility is maximum (e.g., a pixel having the maximum threshold voltage Vth(max)). As shown in FIG. 6, straight lines representing relationships between grayscales of image data and the grayscale compensation value have the same slope (a), regardless of the threshold voltage mobilities.

Meanwhile, in the present disclosure, as shown in FIGS. 5 and 6, a grayscale can be stably compensated without restricting the range of compensation with respect to all grayscales, even when movement of a threshold voltage in a negative direction occurs in an arbitrary pixel.

The display device 100 stores information on the grayscale compensation value determined with respect to each of the pixels 111 (305). For example, the timing controller 160 may store the grayscale compensation level determined with respect to each of the pixel 111 and value α in the form of a lookup table in the memory 170.

The display device 100 may perform image data correction (306). For example, the display device 100 may correct input image data (e.g., first image data DATA1) received from the outside by using information on the stored grayscale compensation value, and may generate corrected image data (e.g., second image data DATA2), and may then supply the corrected image data to the data driver 130.

To this end, the display device 100 may determine a grayscale of the input image data. The display device 100 may load a grayscale compensation level stored in the memory 170 with respect to a pixel 111 in which the input image data is to be displayed and the value α. The display device 100 may calculate a grayscale compensation value, using the above-described Equation 3, based on the determined grayscale of the input image data, the loaded grayscale compensation level, and the loaded value α. The display device 100 may generate corrected image data corresponding to the grayscale compensation value.

In the display device and the method according to the present disclosure, non-uniformity of luminance due to a variation in threshold voltage between pixels can be reduced or minimized.

Further, in the display device and the method according to the present disclosure, degradation can be compensated with respect to a pixel in which movement of a threshold voltage in a negative direction occurs.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims, with functional equivalents thereof to be included therein.

What is claimed is:

1. A display device comprising:

a display panel comprising pixels;

a sensing unit configured to measure threshold voltages of the pixels, respectively; and a timing controller configured to determine grayscale compensation values with respect to the pixels corresponding to the threshold voltages, respectively, and to compensate input image data with respect to the pixels based on the grayscale compensation values, respectively, wherein the grayscale compensation values have a linear relationship with a grayscale of the input image data by using a linear slope value determined based on the threshold voltages, and are determined by using grayscale compensation levels of the pixels that are determined based on threshold voltage mobilities of the pixels, the threshold voltage mobilities being respectively calculated using the following Equation 1:

$$\Delta Vth = Vth - Vth(\text{target}), \quad \text{Equation 1}$$

wherein ΔVth is the threshold voltage mobility, Vth is a measured threshold voltage, and Vth(target) is the minimum threshold voltage.

2. The display device of claim 1, wherein the timing controller is configured to respectively calculate the threshold voltage mobilities of the pixels based on a minimum threshold voltage among the threshold voltages, to respectively calculate the grayscale compensation levels of the pixels from the threshold voltage mobilities, and to generate the linear slope value and the grayscale compensation values based on the grayscale compensation levels.

3. The display device of claim 2, wherein the grayscale compensation levels are respectively calculated using the following Equation 2:

$$\Delta\text{Gray} = \Delta Vth \times \frac{2^{bit}}{Vdata(\text{max gray}) - Vdata(\text{min gray})}, \quad \text{Equation 2}$$

wherein ΔGray is the grayscale compensation level, ΔVth is the threshold voltage mobility, bit is a bit number of the input image data, Vdata(max gray) is a data voltage corresponding to a maximum grayscale of the input image data, and Vdata(min gray) is a data voltage corresponding to a minimum grayscale of the input image data.

4. The display device of claim 3, wherein the linear slope value is set with respect to each of the pixels, and is calculated using the following Equation 3:

$$\alpha = \frac{2^{bit} - 1 - \Delta\text{GRAY}}{2^{bit} - 1}, \quad \text{Equation 3}$$

wherein α is the linear slope value, and ΔGray is the grayscale compensation level of each of the pixels.

5. The display device of claim 4, wherein the grayscale compensation values are calculated using the following Equation 5:

$$\text{GRAY}' = \alpha \times \text{GRAY} + \Delta\text{GRAY}, \quad \text{Equation 5}$$

wherein GRAY' is the grayscale compensation value, GRAY is the grayscale of the input image data, ΔGray is the grayscale compensation level, α is the linear slope value.

6. The display device of claim 3, wherein the linear slope value is set equally with respect to the pixels, and is calculated using Equation 4:

$$\alpha = \frac{2^{bit} - 1 - \Delta\text{GRAY}}{2^{bit} - 1}, \quad \text{Equation 4}$$

wherein α is the linear slope value, and ΔGray is the grayscale compensation level of a pixel having a maximum threshold voltage among the threshold voltages.

7. The display device of claim 6, wherein the grayscale compensation values are calculated using the following Equation 5:

$$\text{GRAY}' = \alpha \times \text{GRAY} + \Delta\text{GRAY}, \quad \text{Equation 5}$$

wherein GRAY' is the grayscale compensation value, GRAY is the grayscale of the input image data, ΔGray is the grayscale compensation level, α is the linear slope value.

8. The display device of claim 2, wherein the timing controller is configured to store the linear slope value and the grayscale compensation level with respect to each of the pixels in a lookup table.

9. The display device of claim 8, wherein, when externally supplied arbitrary input image data is received, the timing controller is configured to load the linear slope value and the grayscale compensation level, which correspond to a pixel in which the arbitrary input image data is to be displayed, from the lookup table, and is configured to determine the grayscale compensation value with respect to a grayscale of the input image data based on the linear slope value and the grayscale compensation level.

10. A method of compensating for degradation of a display device, the method comprising:

respectively measuring threshold voltages of pixels;

respectively storing grayscale compensation values with respect to the pixels corresponding to the threshold voltages; and compensating for input image data corresponding to the pixels based on the grayscale compensation values, which are defined to have a linear relationship with a grayscale of the input image data according to a linear slope value determined based on the threshold voltages, and which are determined by using grayscale compensation levels of the pixels that are determined based on threshold voltage mobilities of the pixels, the threshold voltage mobilities being respectively calculated using the following Equation 6:

$$\Delta Vth = Vth - Vth(\text{target}), \quad \text{Equation 6}$$

wherein ΔVth is the threshold voltage mobility, Vth is a measured threshold voltage, and Vth(target) is the minimum threshold voltage.

11. The method of claim 10, wherein determining the grayscale compensation values comprises:

respectively calculating the threshold voltage mobilities of the pixels based on a minimum threshold voltage among the threshold voltages;

respectively calculating the grayscale compensation levels of the pixels from the threshold voltage mobilities; and generating the linear slope value and the grayscale compensation values based on the grayscale compensation levels.

12. The method of claim 11, wherein the grayscale compensation levels are calculated using the following Equation 7:

$$\Delta\text{Gray} = \Delta Vth \times \frac{2^{bit}}{Vdata(\text{max gray}) - Vdata(\text{min gray})}, \quad \text{Equation 7}$$

wherein ΔGray is the grayscale compensation level, ΔVth is the threshold voltage mobility, bit is a bit number of the input image data, Vdata(max gray) is a data voltage corresponding to a maximum grayscale of the input image data, and Vdata(min gray) is a data voltage corresponding to a minimum grayscale of the input image data.

13. The method of claim 12, wherein the linear slope value is generated with respect to each of the pixels using the following Equation 8:

$$\alpha = \frac{2^{bit} - 1 - \Delta GRAY}{2^{bit} - 1}, \quad \text{Equation 8}$$

wherein α is the linear slope value, and ΔGray is the grayscale compensation level of each of the pixels.

14. The method of claim 13, wherein the grayscale compensation values are calculated using the following Equation 10:

$$GRAY' = \Delta \times GRAY + \Delta GRAY, \quad \text{Equation 10}$$

wherein GRAY' is the grayscale compensation value, GRAY is the grayscale of the input image data, ΔGray is the grayscale compensation level, α is the linear slope value.

15. The method of claim 12, wherein the linear slope value is equally set with respect to pixels, and is generated using the following Equation 9:

$$\alpha = \frac{2^{bit} - 1 - \Delta GRAY}{2^{bit} - 1}, \quad \text{Equation 9}$$

wherein α is the linear slope value, and ΔGray is the grayscale compensation level of a pixel having a maximum threshold voltage among the threshold voltages.

16. The method of claim 15, wherein the grayscale compensation values are calculated using the following Equation 10:

$$GRAY' = \alpha \times GRAY + \Delta GRAY, \quad \text{Equation 10}$$

wherein GRAY' is the grayscale compensation value, GRAY is the grayscale of the input image data, ΔGray is the grayscale compensation level, α is the linear slope value.

17. The method of claim 11, wherein, in the storing the grayscale compensation values, the linear slope value and the grayscale compensation level with respect to each of the pixels are stored in a lookup table.

18. The method of claim 17, wherein the compensating for the input image data comprises:

when externally supplied arbitrary input image data is received, loading the linear slope value and the grayscale compensation level, which correspond to a pixel in which the arbitrary input image data is to be displayed, from the lookup table;

determining the grayscale compensation value with respect to a grayscale of the input image data based on the linear slope value and the grayscale compensation level; and outputting compensated image data corresponding to the grayscale compensation value.

* * * * *